US005519284A

United States Patent [19]

Pepi

[11] Patent Number: 5,519,284

[45] Date of Patent: May 21, 1996

[54] SHORT PUMPING STEM FOR FLAT DISPLAY SCREENS

[75] Inventor: Richard Pepi, Pourrieres, France

[73] Assignee: Pixel International, France

[21] Appl. No.: 390,703

[22] Filed: Feb. 17, 1995

[30] Foreign Application Priority Data

Feb. 22, 1994 [FR] France ..... 94 02292

[51] Int. Cl.[6] ..... H01J 1/62; H01J 63/04; H01J 17/18; H01J 61/36

[52] U.S. Cl. ..... 313/495; 313/493; 313/623

[58] Field of Search ..... 313/493, 495, 313/623; 417/48, 51; 445/25, 41, 43; 220/2.2; 65/34

[56] References Cited

U.S. PATENT DOCUMENTS

| | | | |
|---|---|---|---|
| 2,473,860 | 6/1949 | Cartun | 220/2.2 |
| 2,491,735 | 12/1949 | Howes | 220/2.2 X |
| 3,239,130 | 7/1963 | Naundorf, Jr. | 417/48 X |
| 3,313,610 | 4/1967 | Wilson et al. | 65/34 |
| 4,395,244 | 7/1983 | Glaser | 445/25 |
| 4,820,225 | 4/1989 | Thompson-Russell et al. | 445/43 |
| 4,926,092 | 5/1990 | Gibson, III et al. | 220/2.2 X |

FOREIGN PATENT DOCUMENTS 857239 11/1952 Germany .

OTHER PUBLICATIONS

IBM Technical Disclosure Bulletin, vol. 17, No. 1, Jun. 1974 pp. 284–285, J. B. Landermann et al. "gas display panel".

*Primary Examiner*—Sandra L. O'Shea
*Assistant Examiner*—Mack Haynes
*Attorney, Agent, or Firm*—Plevy & Associates

[57] ABSTRACT

A short pumping stem for flat display screens, more particularly for microtip flat display screens, generally adaptable to flat display screens constituted by a vacuum chamber, includes, before closure, an exhaust tube whose lower portion is integral with the middle portion of an upper concave wall of a cylindric portion having a diameter larger than the diameter of the tube.

9 Claims, 1 Drawing Sheet

SHORT PUMPING STEM FOR FLAT DISPLAY SCREENS

BACKGROUND OF THE INVENTION

1. Field of the Invention

The present invention relates to a short pumping stem for flat display screens, more particularly for microtip screens.

The invention generally relates to the field of flat display screens constituted by a vacuum chamber, and more particularly to microtip screens, made from two thin glass plates, the back plate, or cathode plate, including a matrix array of electron emitting microtips, and the front plate, or anode plate, being coated with a transparent conductive layer bearing phosphor elements.

2. Discussion of the Related Art

Such microtip screens are usually manufactured according to the following steps: conventionally depositing onto two glass plates the various elements constituting the cathode and the anode; assembling the two plates so as to face each other in their respective definitive position, with interposition of a sealing fusible joint at their periphery to form a vacuum chamber; generating a vacuum and maintaining it in the chamber while the latter is heated for degassing the components; and cooling the chamber.

The last phase requires the provision, on one of the plates, of an exhaust tube, or pumping stem, to which an exhaust pipe is connected. The pumping stem is in turn closed once a vacuum and degassing are achieved, but an external protuberance still remains, which increases the thickness of the manufactured device. In addition, the pumping stem renders the plate on which it is positioned more fragile; so, particular care is required to handle and to store the plate and the screen.

The elements contained in any vacuum electron tube diffuse varying quantities of gases inside the chamber. The presence of these gases significantly impairs the operation of the vacuum tube, more particularly in the case of flat display screens which include active elements of very low size and which are separated by extremely short distances. This spurious degassing increases the pressure in the chamber which is detrimental for the correct operation of the screen and may cause the screen to be inactive despite the presence of a gas trap generally constituted by a getter for adsorption of the diffused gas. This getter is generally formed by a prefabricated element generally made of a barium-aluminum alloy, in the form of a plate, a strip or a bar, which is introduced into the chamber before a vacuum is generated. However, the small space available in flat display screens does not allow the use of elements having a sufficient surface to prevent them from saturating, which occurs after a determined service time. So, the getter is generally positioned in the pumping stem which, accordingly, must have a non-negligible length.

SUMMARY OF THE INVENTION

An object of the present invention is to provide a device avoiding the above-mentioned drawbacks. Without modifying the conventional method for mounting the pumping stems, the invention aims at reducing the thickness of the manufactured screen, to increase the strength of the pumping stem and to suppress protrusions which overhang out of the screen. The invention further provides a much better efficiency of the getter system due to the possibility of positioning a plurality of getters without increasing the length of the pumping stem, which significantly increases the gas adsorption surface.

To achieve these objects, the present invention provides a pumping stem including both a gas exhaust tube having a small-diameter closing section, and a swelling ring portion for accommodating a plurality of gas adsorption elements.

The foregoing and other objects, features, aspects and advantages of the invention will become apparent from the following detailed description of the present invention when taken in conjunction with the accompanying drawings.

DETAILED DESCRIPTION

Figure 1:
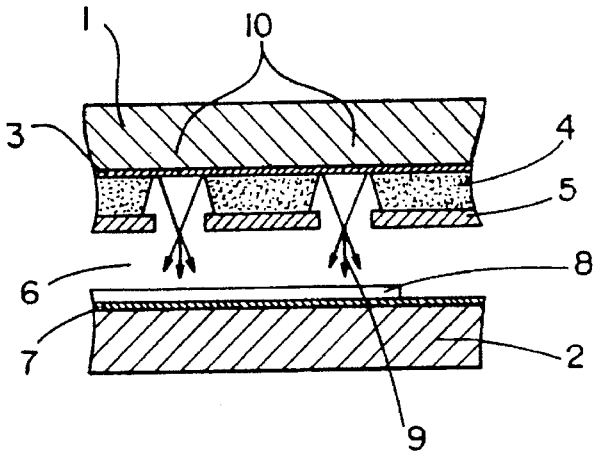
Fig 1 ( prior art )
FIG. 1 is a vertical cross-sectional view illustrating the operation mode of a microtip display screen.

FIG. 1 schematically represents the principle on which is based a microtip flat screen where the following elements are shown from top to bottom: a cathode plate 1 made of glass or silicon, cathode conductors or column conductors 3, an insulating layer 4, row conductors or grid 5, a vacuum chamber 6 and a front glass plate, or anode plate, 2 coated on its inner surface with a transparent conductive layer constituting the anode 7, and phosphors 8.

An electron beam 9, transmitted under a vacuum by microtips 10 electrically connected to the cathode conductors and modulated by the voltage of grid 5, is accelerated toward anode 7 where the electron beam excites the phosphor elements 8.

Figure 2:
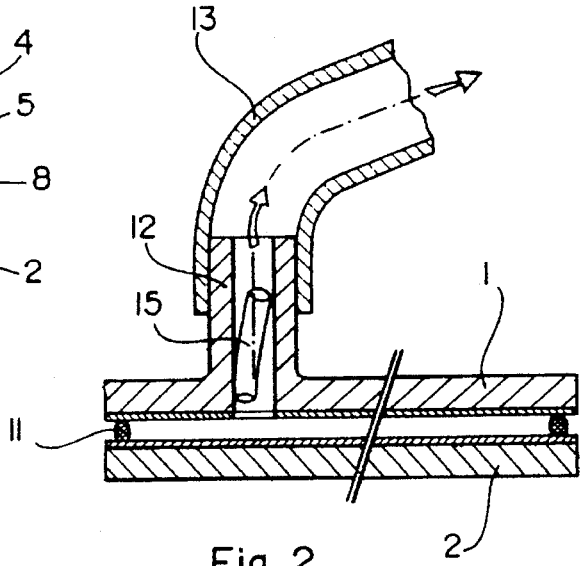
Fig 2 ( prior art )
FIG. 2 illustrates the conventional method for generating a vacuum in a flat display screen.

Referring to FIG. 2, a conventional process for mounting a microtip flat display screen consists in assembling the cathode plate 1 and anode plate 2 at their respective definitive position, then in hot-sealing them with a fusible peripheral joint 11 previously disposed over the cathode plate 1. A pumping stem 12, i.e., a short glass tube, is sealed facing an aperture formed in plate 1. Sealing is preferably achieved with the same material as the material used to seal plates 1 and 2 together. This material is, for example, a fusible lead glass, a sintered glass, or an epoxy glue. The pumping stem 12 is connected to an exhaust pipe 13 for generating a vacuum between the two plates. To ensure sufficient degassing of the cathode and anode components, the whole structure is progressively heated to avoid thermal chock; then, after a predetermined time, the structure is cooled. The pumping stem 12 is then closed generally by fusing after introduction into its aperture of a getter material 15. The presence of this getter material requires a non-negligible length of the pumping stem after sealing.

Figure 3:
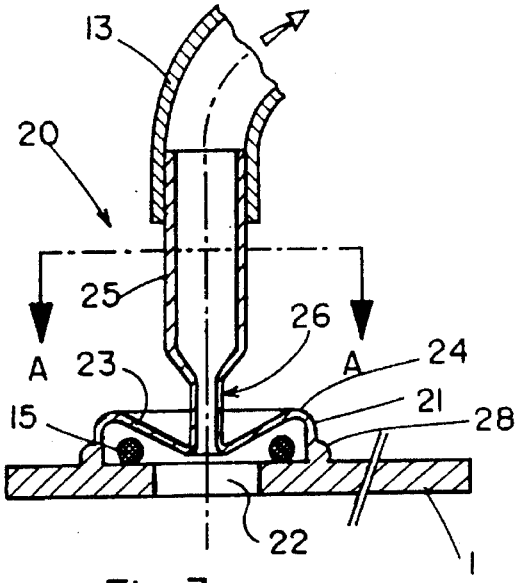
FIGS. 3 and 4 are an axial cross-sectional view and a cross-sectional view along line A—A, respectively, of a pumping stem before closure according to the present invention.
Figure 4:
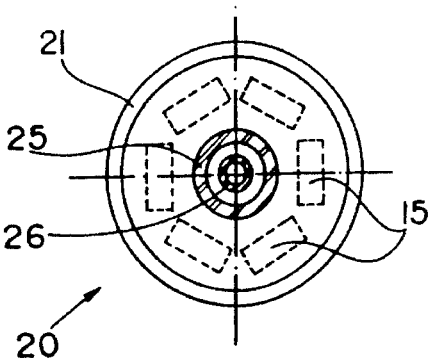

FIG. 3 represents a cross-sectional view of a pumping stem 20 according to the invention and FIG. 4 is a top cross-sectional view along line A—A of FIG. 3. The pumping stem is represented after it is sealed to plate 1 and coupled to an exhaust pipe 13. The pumping stem 20, usually made of glass, includes a first cylindrical portion, or swelling portion, 21 having a diameter significantly larger than the diameter of aperture 22 which is formed in plate 1. This cylindrical portion 21 includes an upper concave wall 23, inwardly directed with respect to the upper ring 24 of cylinder 21. A tube 25 extends outwardly from the middle of wall 28. The tube 25 preferably includes a reduced section portion 26 close to its coupling with wall 23. The cylindrical portion 21 is conventionally sealed or glued to plate 1 with a sealing product 28.

Figure 5:
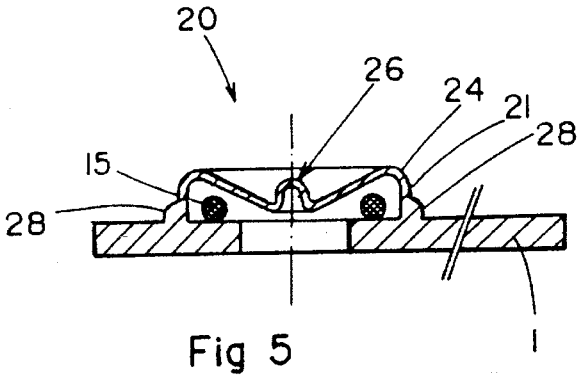
FIGS. 5 and 6 are an axial cross-sectional view and a top view, respectively, of the pumping stem after closure according to the present invention.
Figure 6:
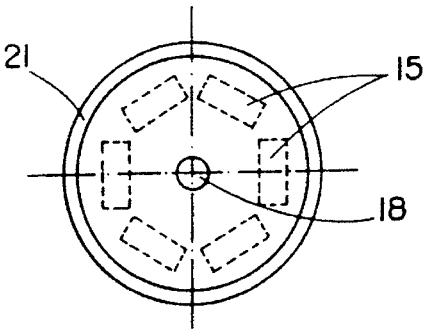

FIGS. 5 and 6 are a cross-sectional view and a top view, respectively, of a pumping stem according to the invention after closure. The invention provides two advantages.

According to a first advantage of the invention, the peripheral annular swelling portion defined by h cylindric portion 21 makes it possible to dispose in the swelling portion at the periphery (radially or in ring shape) a plurality of getter elements 15, in the form of cylindrical bars, strips or any other suitable element, and to dispose a getter layer in the swelling area through evaporation. Thus, the size of the getters can be increased with respect to the prior art without increasing the protuberance with respect to the surface of the cathode plate. The advantage of disposing the getter peripherally with respect to the exhaust tube is that the section of the exhaust tube is not reduced before closure of the tube.

According to a second advantage of the invention, that clearly appears in FIG. 5, the concavity of the upper wall 23 allows the closure of the exhaust tube 26 to be internal with respect to ring 24. Thus, after sealing, the remaining portion of the exhaust tube 26 is entirely included within the swelling portion 24. The swelling portion 24, because of its size, has a better resistance to chocks, thus protecting the fragile portion of the welding.

The described pumping stem can be used without any adsorption element in order to decrease the size and brittleness of the screen.

The inner volume of the swelling portion can advantageously be used to accommodate any type of adsorption elements, or even other elements or accessories which are difficult to place between the two plates forming the screen.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended to be limiting. The invention is limited only as defined in the following claims and the equivalents thereto.

I claim:

1. A short pumping stem for flat display screens, more particularly for microtip flat display screens, generally adaptable to flat display screens constituted by a vacuum chamber, including, before closure, an exhaust tube (25) whose lower portion is integral with the middle portion of an upper concave wall of a cylindric portion (21) having a diameter larger than the diameter of said tube.

2. The pumping stem of claim 1, wherein said tube (25) includes near its coupling with said upper wall a portion (26) with a reduced section.

3. The pumping stem of claim 1, wherein, after closure, the upper extremity of said tube (25) stands back with respect to the upper plane of said cylindric portion.

4. The pumping stem of claim 2, wherein the upper extremity of said tube is sealed at its portion having a reduced section.

5. The pumping stem of claim 1, wherein the inner volume of a swelling portion defined by the cylindric portion (21) includes one or more getter elements (15).

6. The pumping stem of claim 5, wherein the getters are formed by cylindric bars annularly disposed inside the annular swelling portion.

7. The pumping stem of claim 5, wherein the getters are formed by cylindric bars radially disposed inside the annular swelling portion.

8. The pumping stem of claim 5, wherein the getters are formed by strips disposed inside the annular swelling portion.

9. The pumping stem of claim 5, wherein the getters are constituted by a layer formed through evaporation.

* * * * *